US006792922B2

(12) United States Patent
Simon et al.

(10) Patent No.: US 6,792,922 B2
(45) Date of Patent: Sep. 21, 2004

(54) INJECTION PUMP HAVING COLD START ACCELERATION FOR DIRECT INJECTION INTERNAL COMBUSTION ENGINES

(75) Inventors: Helmut Simon, Goeppingen (DE); Helmut Haberer, Gerlingen-Gehenbuehl (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/295,324

(22) Filed: Nov. 15, 2002

(65) Prior Publication Data

US 2003/0116139 A1 Jun. 26, 2003

(30) Foreign Application Priority Data

Nov. 16, 2001 (DE) ..... 101 56 338

(51) Int. Cl.[7] ..... F02M 37/04
(52) U.S. Cl. ..... 123/502; 123/179.17
(58) Field of Search ..... 123/179.17, 502, 123/500, 501, 449, 357

(56) References Cited

U.S. PATENT DOCUMENTS 3,897,764 A * 8/1975 Bakti ..... 123/502
4,037,574 A * 7/1977 Swift ..... 123/502
4,333,437 A * 6/1982 Lohner et al. ..... 123/502
4,408,591 A * 10/1983 Nakamura ..... 123/502
4,557,240 A * 12/1985 Sakuranaka ..... 123/502
4,610,234 A * 9/1986 Sakuranaka ..... 123/502
5,370,096 A * 12/1994 Cooke ..... 123/502
5,647,327 A * 7/1997 Enomoto et al. ..... 123/502
6,453,880 B1 * 9/2002 Nicol et al. ..... 123/502

* cited by examiner

*Primary Examiner*—Carl S. Miller
(74) *Attorney, Agent, or Firm*—Kenyon & Kenyon

(57) ABSTRACT

A fuel delivery unit for an internal combustion engine including a housing, which includes a timing unit for shifting the point of injection of fuel into the combustion chambers of the internal combustion engine. An injection timing piston is accommodated in the timing unit, which is displaceably mounted in the timing unit and which encloses a trailing piston displaceably relative thereto. The timing unit contains a pressure chamber which may be pressurized/depressurized via an actuator, a cold start accelerator piston being movable via the pressure chamber, acting upon both the trailing piston via a spring element and, together with a spring-sleeve combination, influencing the injection timing piston.

11 Claims, 2 Drawing Sheets

INJECTION PUMP HAVING COLD START ACCELERATION FOR DIRECT INJECTION INTERNAL COMBUSTION ENGINES

BACKGROUND INFORMATION

In accordance with increasingly strict exhaust gas regulations for gasoline engines and compression ignited internal combustion engines, the start of injection, for example, for compression ignited engines, may be adjusted to the particular operating phase of the engine. In the cold start phase, for example, at low outside temperatures, the start of injection of diesel distributor injection pumps must be advanced, thus making a low-emission start with reduced particle emission and reduced noise possible. As the rotational speed of the compression ignited engine increases, the delivery start of the injection pump may be advanced in order to compensate for the time shift caused by the delayed injection and ignition.

After the injection operation, diesel fuel may require a certain time period to form an ignitable mixture, which self-ignites at high pressure. The time period required for this purpose between injection start and combustion start is known in compression ignited internal combustion engines as ignition delay. The ignition delay is determined, among other factors, by the ignitability of the diesel fuel (expressed by the cetane number), the achievable compression ratio of the compression ignited internal combustion engine, and the quality of fuel atomization by the injection nozzle of the fuel injector. The ignition delay of compression ignited engines may be on the order of magnitude of 1–2 ms. During the cold start phase, for example, at low outside temperatures, this time period becomes longer, resulting in soot production by the uncombusted fuel, which is discharged into the environment through the exhaust system.

In the case of distributor injection pumps of compression ignited engines, different cold start accelerators may be used. A hydraulic measure for accelerating cold starts is to temporarily raise the internal pressure of the distributor injection pump during the cold start and during the immediately subsequent cold running phase of compression ignited internal combustion engines. As the internal pressure is raised, an injection timing piston is displaced, resulting in the injection start being advanced. The disadvantage of this measure is the subsequent loose run of the injection timing piston due to the slow decrease in pressure in the interior of the distributor injection pump.

Another option for advancing the injection start is to advance the injection timing piston and thus the injection start by rotating a component designed as a roller ring during the start and during the cold running phase of the compression ignited engine. Another measure which may be carried out using mechanical means is to displace the injection timing piston by pressing on one side of the injection timing piston using a cam shaft so that the injection start is advanced. Using the above-mentioned measure, a small amount of adjustment may be possible, limited by the mechanical overstress of the components involved, and thus only a limited advance of the injection start may be achievable.

SUMMARY

The displacement of the injection timing piston in the direction of advancing the injection start takes place during the cold phase by opening the inlet bore using a trailing piston. The trailing piston may also be designed, for example, as a servo piston or a regulating slide. The function of this component is to open and close the inlet and the outlet of the injection timing piston.

In the cold position of the distributor injection pump, the pressure chamber associated with the timing piston is initially empty; it begins to fill up during the subsequent warm-up phase of the engine as the rotational speed increases. As the interior of the distributor injection pump gradually fills up, the internal pressure increases.

The injection timing piston is adjustable with a short response time using a cold start accelerator piston. At the low rotational speeds that occur in the start phase of the engine, an earlier loose run of the injection timing piston may be achieved without the need for a complete high-pressure buildup in the interior of the pump. A high-pressure buildup in the pump chamber is not required for the method according to the present invention; therefore, the injection timing piston may be advanced in a timely manner so that an earlier injection may be achieved even during the first revolutions of the engine. An earlier injection may improve fuel atomization during injection, so that the ignitability of the fuel mixture within the combustion chamber increases. According to the present invention, this may result in both reduced particle emission during the start and cold running phase and in quicker starting of the compression ignited engine.

The injection timing piston of the distributor injection pump may be advanced for an earlier injection start using a trailing piston, which opens or closes an inlet bore. The trailing piston, which may be moved by a spring-sleeve combination, may be supported by a cold start accelerator piston whose front extends into a pressure chamber. The trailing piston, which may be designed, for example, as a regulating slide various embodiment options, opens and closes the inlet and outlet of the injection timing piston, so that the latter shifts the injection timing according to the operating state of the compression ignited engine. When the distributor injection pump and the engine are cold, the engine has no pressure in this pressure chamber, so that the front of the cold start accelerator piston protrudes into this pressure chamber. The end of the cold start accelerator piston facing away from the front face functions as a movable support surface for the spring-sleeve combination of the trailing piston. The cold start accelerator piston is in turn displaced by the pressure in the pressure chamber of the cold start accelerator unit. At start and during the cold running phase of the engine, the pressure chamber is empty and is not filled until the start of the warm-up phase of the engine. This increases the pressure in the pressure chamber, the cold start accelerator piston is displaced so that the trailing piston assumes its normal position, and the injection start advance is reversed.

In addition, it is possible to operate external triggering devices, such as a load-dependent delivery start timer, for example, using the cold start accelerator piston of the distributor injection pump. This function is activated via an annular groove, for example. When the compression ignited engine is cold, this external triggering device is off, i.e., the orifice designed as a groove, for example, or the corresponding bore remains closed. As the compression ignited engine gradually warms up, the load-dependent delivery start timing function may be turned on, because the internal pressure in the interior of the distributor injection pump increases. The load-dependent delivery start timing is triggered when the orifice is open.

DETAILED DESCRIPTION

Figure 1:
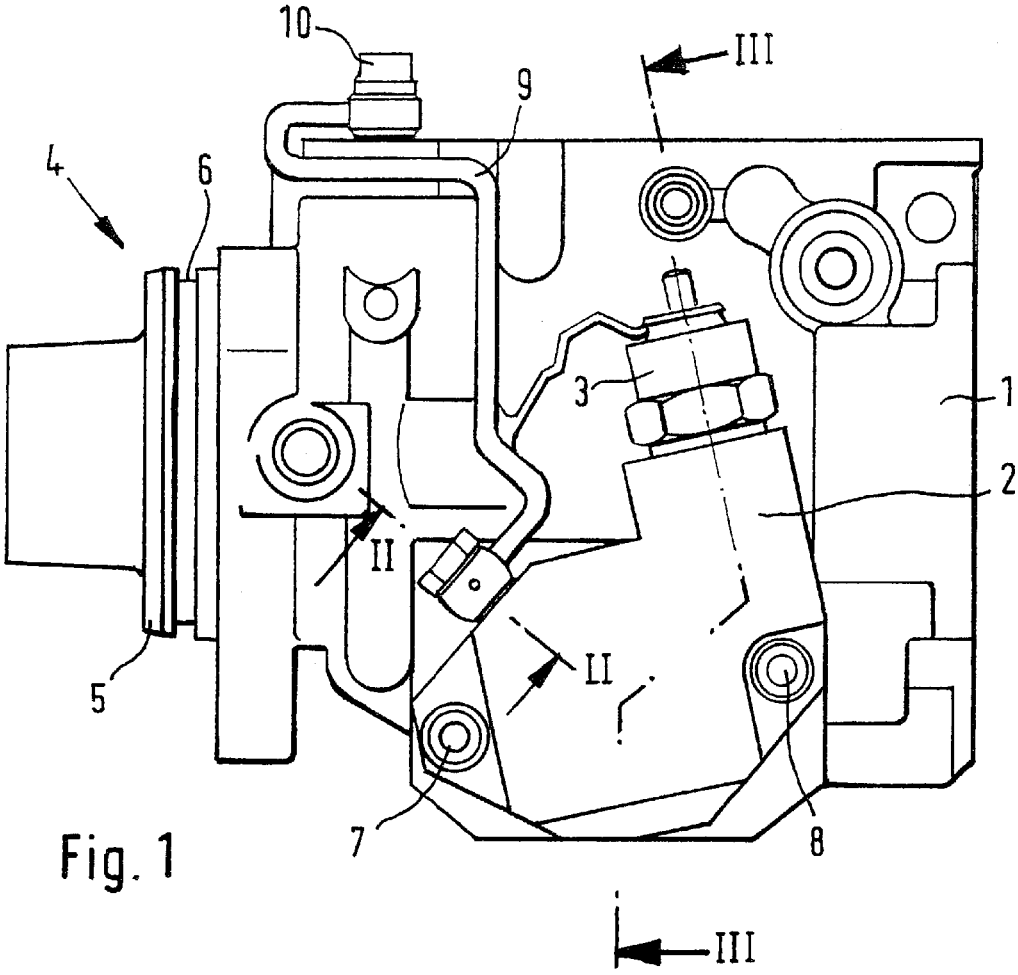
FIG. 1 illustrates a side view of an example embodiment of a distributor injection pump according to the present invention, showing section planes II—II and III—III.

FIG. 1 shows the side view of an example embodiment of the distributor injection pump according to the present invention having a flange-connected timing unit for the injection timing piston.

The illustration of the example embodiment of FIG. 1 shows a side view of a distributor injection pump housing 1. A timing unit 2 for shifting the point of injection of fuel is flange-connected to housing 1 of the distributor injection pump. It is attached to the side of housing 1 of the distributor injection pump by flange bolts 7 and 8. An actuator in the form of an electromagnet 3 is associated with timing unit 2 for shifting the point of injection of fuel.

A connecting lead 9 for controlling the load-dependent delivery start timing function is provided between housing 1 of the distributor injection pump and injection start timing unit 2. Connecting lead 9 is attached to the top of housing 1 of the distributor injection pump by a hollow screw 10. Roman numerals II—II and III—III denote the cross sections shown in FIGS. 2 and 3.

Figure 2:
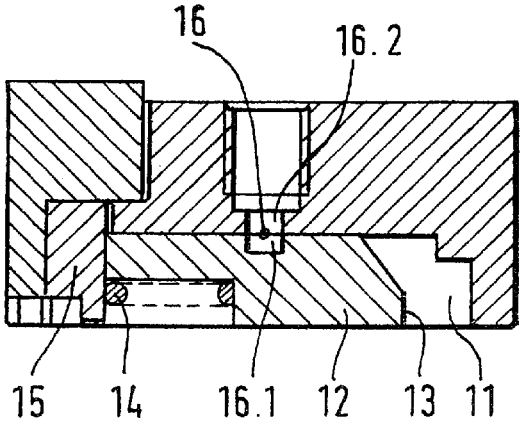
FIG. 2 illustrates the position of an outlet bore on the trailing servo piston of an example embodiment of the injection pump according to the present invention.

FIG. 2 shows the position of a control groove for triggering a load-dependent delivery start timing function of the distributor injection pump of FIG. 1.

The sectional representation of FIG. 2 shows that a cold start accelerator piston 12 movably mounted in injection start timing unit 2 may be mounted in timing unit 2 using an associated spring element 14. A pressure chamber 11 is formed in timing unit 2, i.e., between a wall of the same and a face 13 of cold start accelerator piston 12. On the outside of the lateral surface of cold start accelerator piston 12 there is an annular groove 16.1, which cooperates with an orifice 16.2 in the housing of the injection start timing unit, forming an outlet bore 16 with orifice 16.2. Outlet bore 16, i.e., the cooperation of annular groove 16.1 of cold start accelerator piston 12 with housing bore 16.2 allows a load-dependent delivery start timing function without external circuitry on injection start timing unit 2. The method according to the present invention allows the load-dependent delivery start timing function to be controlled depending on the operating state of the compression ignited engine, i.e., turned off when cold and turned on when warm, without the need for external circuitry operated from the outside.

Piston spring 14, acting upon cold start accelerator piston 12, may be supported both by a support surface within the piston and by a support disk 15, which may be attached to housing 1 of the distributor injection pump using fastening screws.

Figure 3:
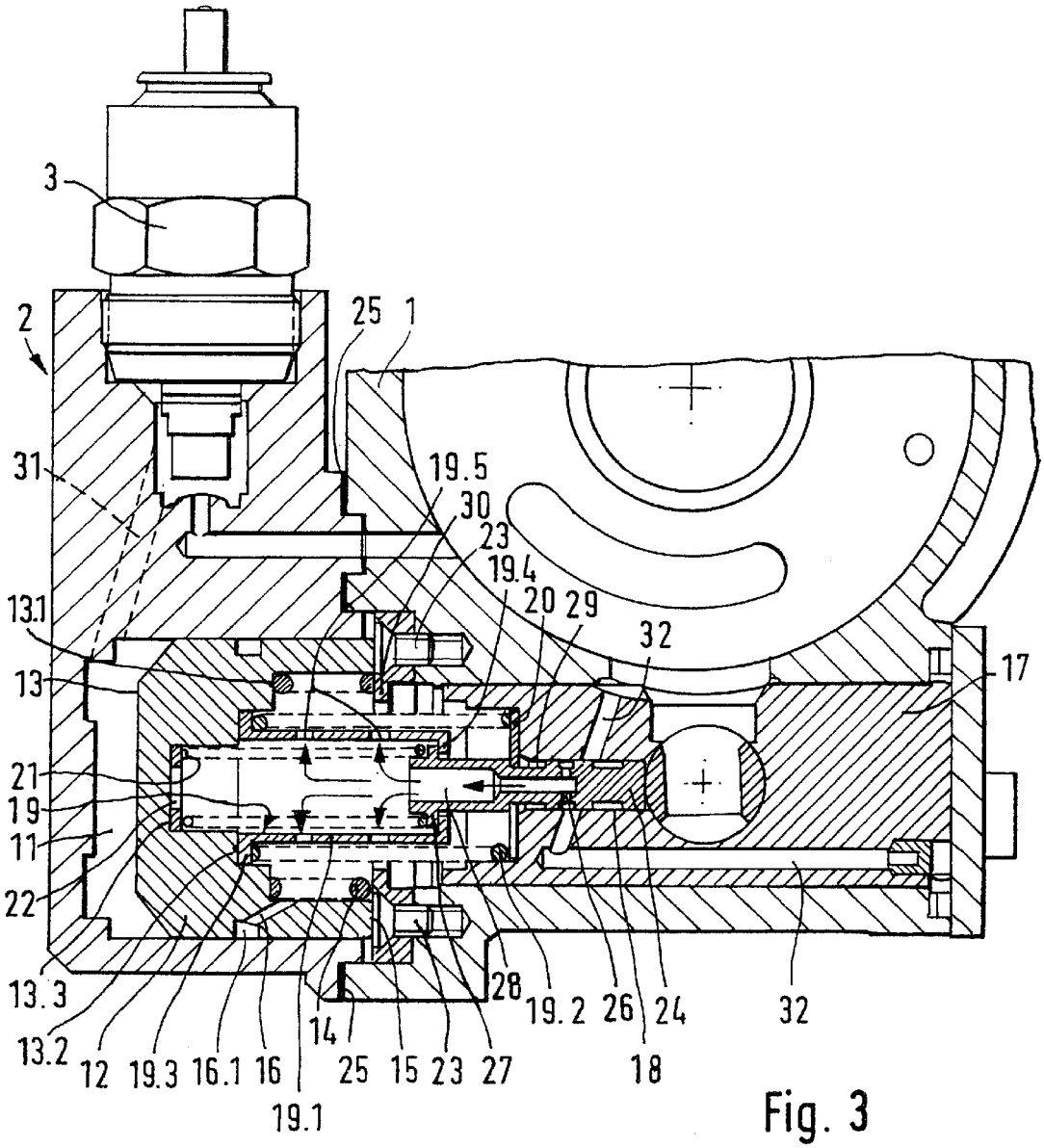
FIG. 3 illustrates a longitudinal section through the cold start accelerator piston below an electromagnet on an example embodiment of the distributor injection pump according to the present invention.

FIG. 3 shows a longitudinal section through the cold start accelerator piston within the injection start timing unit underneath an electromagnet.

In FIG. 3, housing 1 of the distributor injection pump and the housing of injection start timing unit 2 are shown combined into a single component. Housings 1 and 2 may be sealed against each other by a gasket plate 25 along a joint which extends vertically.

An actuator in the form of an electromagnet 3 may be situated in the upper area of the housing of injection start timing unit 2. It allows the pressure in pressure chamber 11 of injection start timing unit 2 to be relieved via a relief bore 31, here shown as a shaded area.

An injection timing piston 17 may be movably mounted in injection start timing unit 2 underneath housing 1 of the distributor injection pump. Injection timing piston 17 includes, for example, two inlet orifices oriented at an angle to one another.

Furthermore, a rotatably mounted insert may be located in injection timing piston 17; with the displacement of injection start timing piston 17, this insert moves a ring mounted in housing 1 of the distributor injection pump between advanced and retarded injection start depending on the operating state of the compression ignited engine.

A cold start accelerator piston 12 may be displaceably mounted in the housing of injection start timing unit 2. Face 13 of the cold start accelerator piston and the inside of the housing of injection start timing unit 2 may be adjacent to a pressure chamber 11. The pressure chamber, delimited by the inside of cold start accelerator piston 12 and by the face of injection start timing piston 17, is depressurized. An orifice 16, shaped as a groove, for example, which, when closed, turns off an external triggering such as the load-dependent delivery start timing function and turns on the load-dependent delivery start timing function when the distributor injection pump is warm, branches off from this pressure chamber; if the load-dependent delivery start timing function is on, orifice 16, shaped as a groove, for example, is open.

Cold start accelerator piston 12 includes, on its side facing away from end face 13, stop (contact) surfaces 13.1, 13.2, and 13.3. Each of these surfaces 13.1, 13.2, and 13.3 functions as a support surface for spring elements designed, for example, as helical springs.

A spring element 14, acting upon cold start accelerator piston 12 using a spring force is supported by first stop surface 13.1 on the inside of cold start accelerator piston 12 and by a support ring 15 mounted on housings 1 and 2. Support ring 15 may be screwed into the housings via fastening elements—preferably insertion screws—which are identified with reference number 23, and unmovably secured. A spring/sleeve combination 19 may be supported by second stop surface 13.2 on the inside of cold start accelerator piston 12. The spring/sleeve combination includes a sleeve 19.1 and a spring element 19.2 mounted therein. Spring element 19.2 is supported by a first stop ring 19.3 of spring/sleeve combination 19 and a slotted disk 20 located opposite first stop ring 19.3. Slotted disk 20 in turn rests on the bottom surface of a recess on a face of injection timing piston 17. First stop ring 19.3 of sleeve 19.1 of spring/sleeve combination 19 rests on second stop surface 13.2 of cold start accelerator piston 12 and is acted upon by spring element 19.2. Second stop ring 19.4 of sleeve 19.1 encloses a support disk 27 of a trailing piston 24.

In addition, trailing piston 24 is acted upon by a spring force via a trailing piston spring 21, with trailing piston spring 21 being supported by a ring 22 supported by third stop surface 13.1 of cold start accelerator piston 12. Trailing piston 24 is in turn traversed by a channel system which includes a transverse bore 26 and a longitudinal bore 28 having stepped diameters, which is connected to transverse bore 26.

In addition, recesses 29, into which the legs of slotted disk 20 protrude thus limiting the maximum displacement path of trailing piston 24 in injection timing piston 17, are formed on trailing piston 24.

At the time of cold start of a compression ignited engine, actuator 3 designed as an electromagnet, may be connected in such a way that pressure chamber 11 of actuator unit 2 is depressurized for timing the injection start. Therefore no counter-force acts against spring elements 14 and 19.2, which act upon cold start accelerator piston 12 at stop surfaces 13.1 and 13.2, via pressure chamber 11, so that said spring elements may assume their rest position. This causes trailing piston 24 to be displaced on its support disk 27 by second stop ring 19.4 of sleeve 19.1 due to the relaxation of spring element 19.2 of spring/sleeve combination 19 and due to sleeve 19.1 cooperating therewith, so that the inlet bores become connected to channel system 26 and 28 inside trailing piston 24. This adjusts the distributor injection pump to cause an early start of injection of fuel into the individual combustion chambers of the compression ignited engine. Thus the particle and noise emission at the start of the engine and during the subsequent cold running phase may be reduced.

With increasing operating time, the engine and the distributor injection pump warm up. During the warm-up phase of the compression ignited engine, which follows the cold running phase, solenoid 3 is switched, and fluid flows into pressure chamber 11, causing an increase in pressure in pressure chamber 11; the increase in pressure directly acts upon face 13 of cold start accelerator piston 12, pushing it against the pressure force in its cavity.

In normal operation, i.e., when the compression ignited engine has warmed up, the control of trailing piston 24 is assumed by spring element 21, which is supported by third stop surface 13.3 on the inside of cold start accelerator piston 12 and acts upon trailing piston 24 independently of spring elements 14 and 19.1.

The above-described external triggering of a load-dependent delivery start timing function, which may take place by opening and closing a groove or a bore 16, is an example of a function which may be triggered as a function of the operating state of the compression ignited engine without external circuitry. The components associated with the implementation according to the preceding description, such as outlet bore 16, connecting pipe 9 allowing the fluid to overflow, and hollow screw 10 which accommodates the connecting pipe are mentioned only as examples and may not influence the function of cold start accelerator piston 12.

What is claimed is:

1. A fuel delivery unit, comprising:

a housing;

a timing unit disposed in the housing configured to shift a point of injection of fuel into a combustion chamber of an internal combustion engine, the timing unit including a pressure chamber which is configured to be at least one of pressurized and depressurized by an actuator;

an injection timing piston movably disposed in the timing unit;

a trailing piston/regulating slide disposed within the injection timing piston configured to be displaceable relative to the injection timing piston; and a cold start accelerator piston configured to be displaced by the pressure chamber and to act on the trailing piston/regulating slide via a spring element;

wherein the cold start accelerator piston is further configured to act on the injection timing piston via a spring-sleeve combination.

2. The fuel delivery unit according to claim 1, wherein a side of the cold start accelerator piston facing the injection timing piston includes stepped contact surfaces.

3. The fuel delivery unit according to claim 1, wherein a lateral surface of the cold start accelerator piston includes an orifice which together with an orifice on a housing side of the cold start accelerator piston, forms an outlet for triggering external functions.

4. The fuel delivery unit according to claim 1, further comprising:

a spring element supported on a support surface of the timing unit and resting on a first contact surface of the cold start accelerator piston.

5. The fuel delivery according to claim 2, wherein the spring-sleeve combination is disposed between a second contact surface of the cold start accelerator piston and a front face of the injection timing piston.

6. The fuel delivery unit according to claim 5, wherein the spring-sleeve combination includes a sleeve, the sleeve including a first stop ring disposed on the second contact surface of the cold start accelerator piston and further including a second contact ring enclosing a support disk of the trailing piston/regulating slide.

7. The fuel delivery unit according to claim 5, wherein the spring-sleeve combination includes a spring element configured to prestress the first stop ring of the sleeve and the injection timing piston against one another.

8. The fuel delivery unit according to claim 2, further comprising:

a spring element disposed between the trailing piston/regulating slide and a third stop surface of the cold start accelerator piston, the spring element configured to act upon the trailing piston/regulating slide.

9. The fuel delivery unit according to claim 6, wherein the sleeve of the spring-sleeve combination has orifices through which fluid exiting channels flows into a cavity.

10. The fuel delivery unit according to claim 1, wherein the displacement of the trailing piston/regulating slide within a cavity in the injection timing piston is independent of a motion of the injection timing piston into the cavity.

11. The fuel delivery unit according to claim 1, further comprising:

an electromagnet, the pressure chamber of the timing unit is at least one of pressurized and depressurized via the eletromagnet.

* * * * *